US011050199B1

(12) United States Patent
Widner

(10) Patent No.: US 11,050,199 B1
(45) Date of Patent: Jun. 29, 2021

(54) AC ADAPTER WITH TETHERED REMOVABLE PLUG

(71) Applicant: BBY Solutions, Inc, Richfield, MN (US)

(72) Inventor: Roger D Widner, Farmington, MN (US)

(73) Assignee: BBY Solutions, Inc., Richfield, MN (US)

( * ) Notice: Subject to any disclaimer, the term of this patent is extended or adjusted under 35 U.S.C. 154(b) by 0 days.

(21) Appl. No.: 16/797,090

(22) Filed: Feb. 21, 2020

(51) Int. Cl.
*H01R 13/72* (2006.01)
*H01R 31/06* (2006.01)
*H01R 13/66* (2006.01)

(52) U.S. Cl.
CPC ..... *H01R 13/72* (2013.01); *H01R 13/6675* (2013.01); *H01R 31/065* (2013.01)

(58) Field of Classification Search
CPC .... H01R 13/66; H01R 13/6675; H01R 13/72; H01R 31/065
USPC ..... 439/131, 501, 135
See application file for complete search history.

(56) References Cited

U.S. PATENT DOCUMENTS 5,236,371 A * 8/1993 Matthis ..... H02G 11/02 439/501
6,253,893 B1 * 7/2001 Chi-Min ..... H01R 12/592 174/113 R
6,415,898 B1 * 7/2002 Liao ..... H02G 11/02 191/12.4
7,151,356 B1 12/2006 Chen et al.
7,871,291 B2 1/2011 Tracy et al.
8,802,991 B1 8/2014 Hua et al.
10,297,965 B1 * 5/2019 Yang ..... H01R 31/06
10,790,628 B2 * 9/2020 Landwehr ..... H01R 13/6205
2006/0172591 A1 * 8/2006 Huang ..... H01R 31/06 439/501
2011/0272959 A1 * 11/2011 Lupton, III ..... H01R 13/60 296/37.8

* cited by examiner

*Primary Examiner* — Oscar C Jimenez
(74) *Attorney, Agent, or Firm* — Forsgren Fisher; James M. Urzedowski; Daniel A. Tysver

(57) ABSTRACT

An AC adapter having electronics for converting AC electricity to DC voltage is presented herein. The adapter includes an adapter housing, a plug and a built-in extension cord contained within a storage cavity defined by the adapter housing. The extension cord extends from the electronics to the plug. In a first engagement state the plug is mechanically engaged to the adapter housing such that the plug body completely covers the opening into the storage cavity, and the adapter housing and plug are a single structure that may be plugged directly into a wall outlet. In a second engagement state the plug is removed from the mechanical engagement with the adapter housing, and may be plugged into an outlet some distance from the adapter housing as limited by the length of the extension cord, which maintains electrical connection between the plug and the electronics within the adapter housing.

5 Claims, 10 Drawing Sheets

AC ADAPTER WITH TETHERED REMOVABLE PLUG

FIELD OF THE INVENTION

Embodiments of the disclosure described herein are directed to the field of convertible AC power adapters with removeable plugs, which allow the adapter to be directly plugged into a power source, such as a wall outlet, or when removed, may be swapped out with a corded plug or other type of plug module. More specifically, embodiments of the disclosure are directed to an AC adapter having an internal cavity which contains an extension cord that is in electrical engagement with the adapter and the removeable plug. The cord may be deployed from within the adapter when the removeable plug is disconnected from the adapter body thereby providing the adapter with its own built in extension cord and alleviating the need for a second corded plug module.

BACKGROUND OF THE INVENTION

AC adapters, AC/DC adapters or "power adapters" as they are sometimes referred to, are external power supplies that are ubiquitous to modern consumer electronics. From so called "power bricks" with a cord at both ends for supplying power to a personal computer, to direct plug in, single cord, "wall wart" adapters common to cellular phones; AC adapters convert electrical AC current from the power source (typically a wall outlet) to DC voltage, which is then supplied to a consumer electronic device connected at the other end.

Many modern AC adapters are convertible between a direct plug-in capability, to one that uses an extension cord that is plugged directly into the adapter in place of the nominal plug. Examples of such convertible AC adapters may be found in U.S. Design Pat. Nos. D661,649; D784,921. These types of adapters come equipped with a plug, with foldable pins or blades that may lay flat within the adapter housing and which may be folded outward from the adapter to allow them to interface with an electrical outlet. In the event that the adapter cannot reach an outlet, or the adapter is too large or heavy to practicably connect to the outlet directly, the plug may be swapped out from the adapter housing and replaced with an extension cord that interfaces with the adapter in the same manner as the original plug. This arrangement however necessitates the adapter having both the remove plug and the extension cord components, wherein one of these components must be separately stored (or discarded) when the other is in use.

SUMMARY OF THE INVENTION

The adapter of the present disclosure is provided with a unique design that eliminates the need for extraneous components by providing the adapter with a unitary plug and extension cord tethered to the adapter. One end of the cord terminates in the plug, and the other end is connected to the electrical components of the adapter within a storage cavity defined by the adapter housing. When the plug is in place on the housing for directly connecting the adapter to an outlet, the extension cord is entirely contained within the storage cavity. When the cord is needed, the plug is disconnected from the adapter housing, and the cord is withdrawn from the cavity while maintaining the electrical connection with the adapter.

BRIEF DESCRIPTION OF THE DRAWINGS

FIG. 10 is a perspective view of the AC adapter shown in FIG. 5 wherein the storage cavity includes a cord retraction mechanism mounted therein that the extension cord is supported on.

DETAILED DESCRIPTION

In accordance with the example embodiments shown in FIGS. 1-10, the present disclosure is directed to an AC Adapter (adapter) 10 which includes an adapter housing 12 to which a removeable plug 14 may be engaged thereto.

Figure 1:
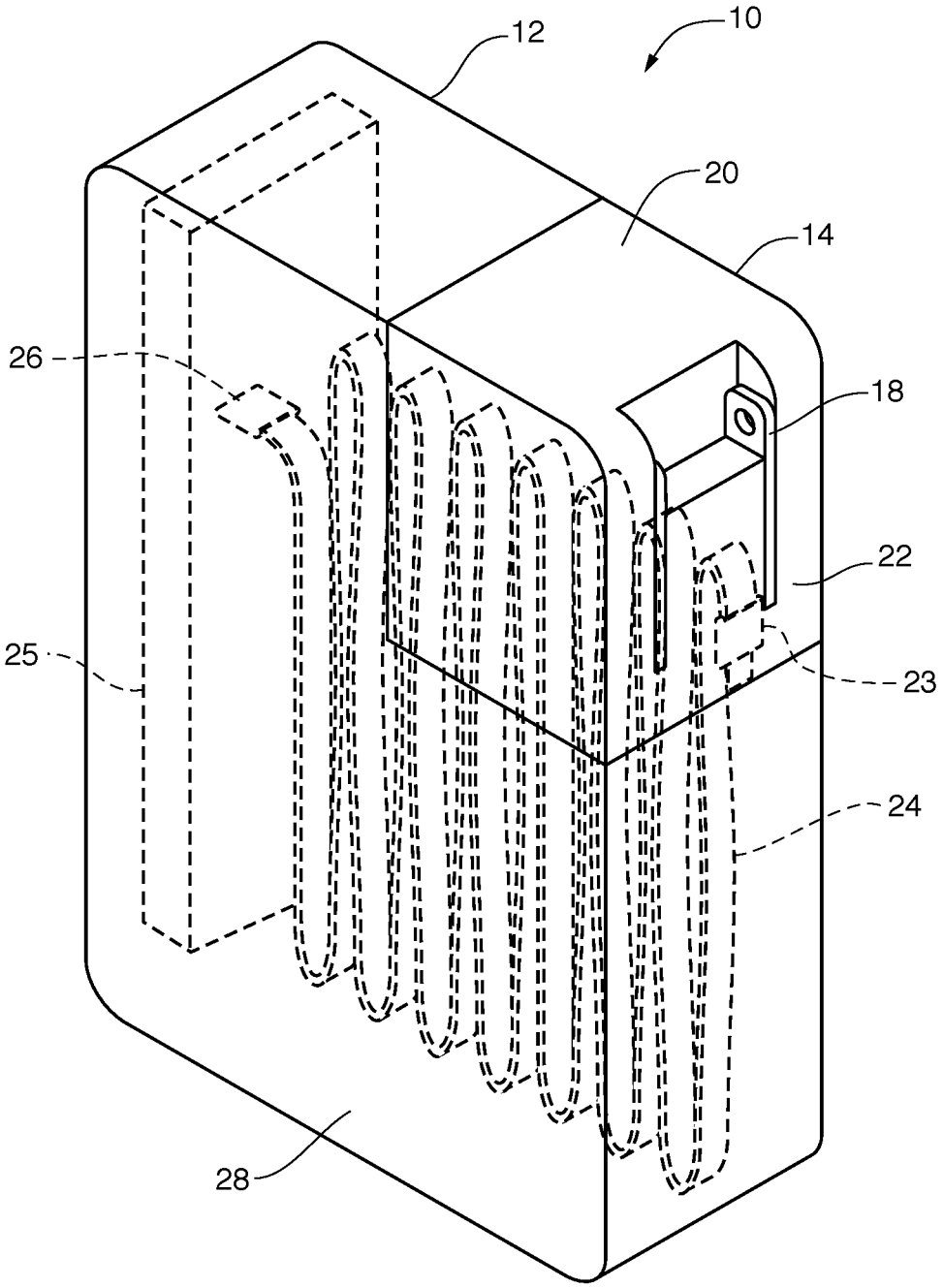
FIG. 1 is a perspective view of an embodiment of an AC adapter shown with an extension cord stored within a storage cavity and the pins of the plug are shown in the folded position.
Figure 2:
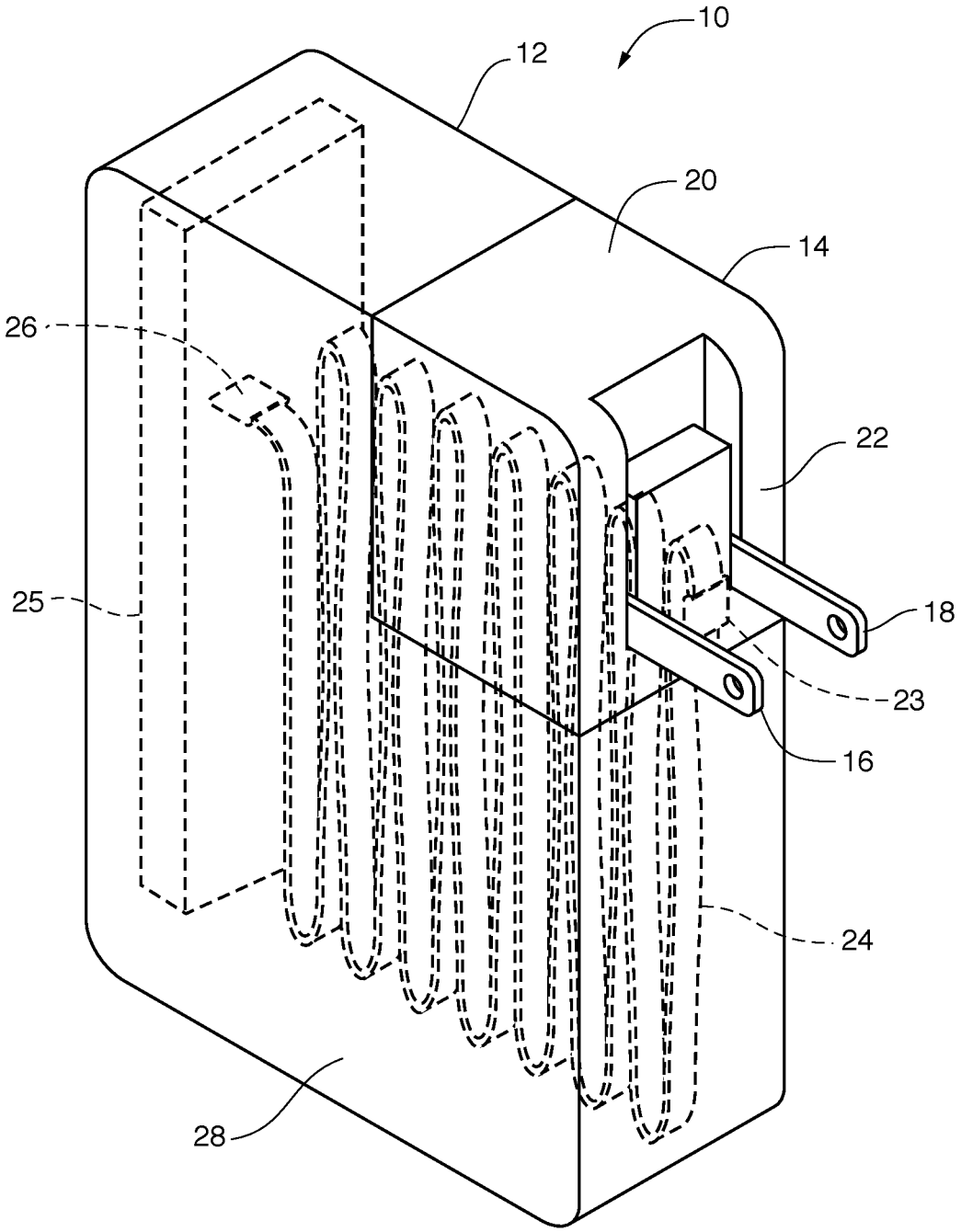
FIG. 2 is a perspective view of the AC adapter shown in FIG. 1, with the plug pins shown in the extend position.
Figure 3:
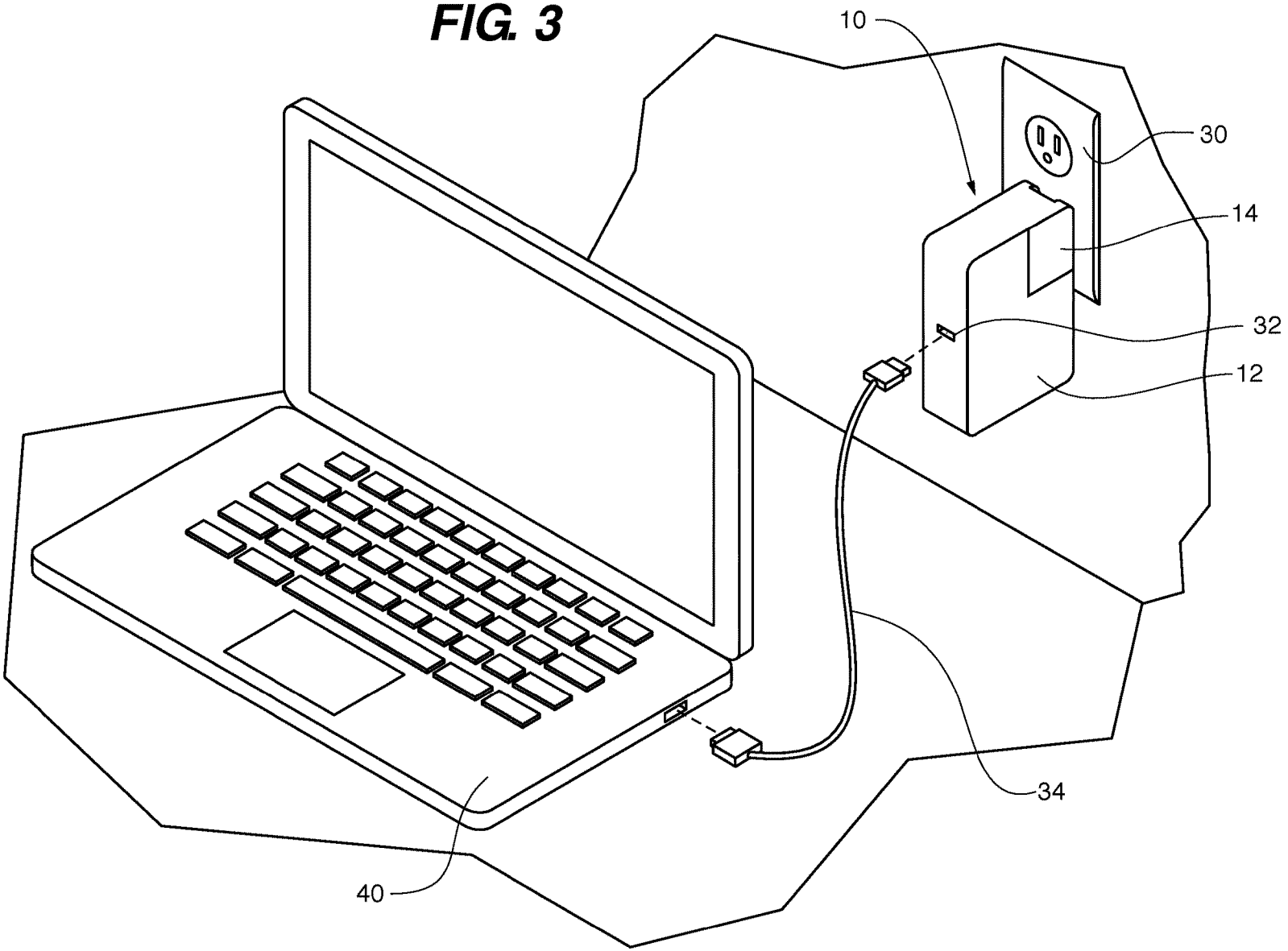
FIG. 3. is a perspective view of the AC adapter shown in FIG. 2, depicted within a typical environment of use, wherein the adapter is shown plugged directly into a wall outlet and a USB (or functionally equivalent) power cord is provided to supply power from the adapter to an electronic device.
Figure 4:
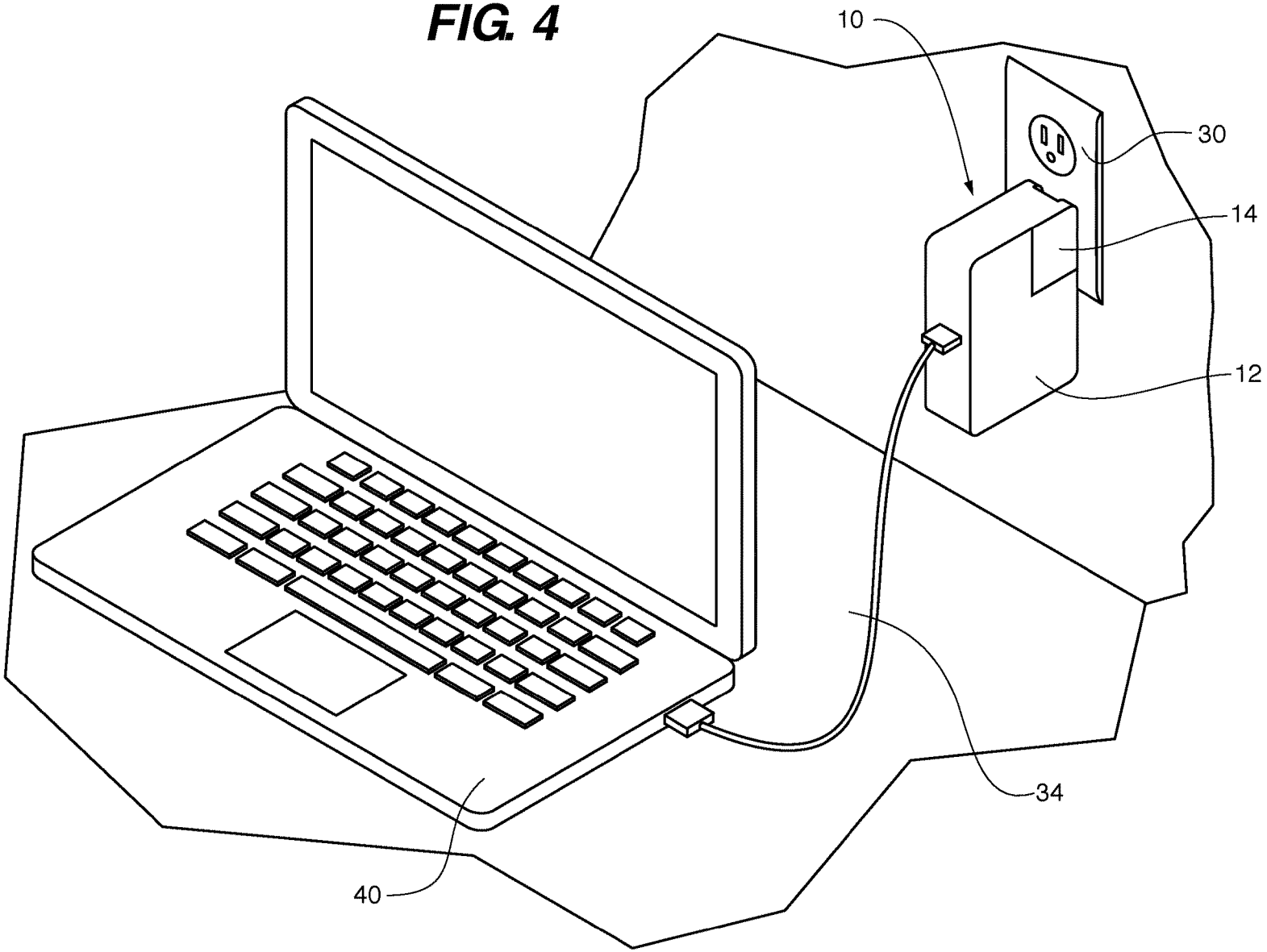
FIG. 4 is the same view as shown in FIG. 4 wherein the USB power cord is connected to the USB port of the adapter and to the receiver port of the electronic device.

The plug 14 is a conventional two-pin folding plug whose electrically conductive pins 16 and 18 are pivotally connected to the plug body 20, and which are pivotal from a folded position wherein the pins are held flush with the front surface 22 of the plug body 20, such as is depicted in FIG. 1; to an extended position, such as is shown in FIG. 2, wherein the pins 16 and 18 extend perpendicularly from the front surface 22. The pins 16 and 18 are in electrical communication with the various electrical components (e.g. diodes, transformer, circuitry, capacitor, etc. depicted collectively as block 25) of the AC adapter 10 via an extension cord 24 that extends from a first connection 23 within the plug 14 to a second connection 26 within an interior storage cavity 28 of the adapter housing 12.

As may be seen in FIGS. 1-2 the extension cord 24 in the default, non-extended or confined state, is confined within the storage cavity 28. In this state the adapter housing 12 and plug 14 are engaged to one another and the adapter 10 is configured for direct connection to a wall outlet 30 such as in the manner shown in FIGS. 3 and 4. As may be seen in FIG. 3, the adapter 10 includes a conventional Universal Serial Bus (USB) or similar equivalent (8-pin Lightning, Micro USB, Mini USB, etc.) port 32 to which an appropriately configured device connection cord 34 is plugged into in order to transmit DC voltage from the electronics 25 within the adapter 10 to an electronic device 40 in the conventional manner.

In many instances however, it may be necessary or desirable to not plug the adapter 10 into a wall outlet 30 directly. The outlet 30 may be too far away from the device 40, the adapter 10 may be too bulky or heavy to properly connect to the outlet 30, etc. In such instances, the plug 14 may be disconnected from the adapter housing 12, and the connected extension cord 24 withdrawn from within the storage cavity 28 of the housing 12 (with the connection 26 remaining connected to the components 25), in order to allow the plug 14 to be connected to the outlet 30 while the rest of the adapter housing 12 is positioned elsewhere, such as in the manner shown in FIGS. 5-7.

Figure 5:
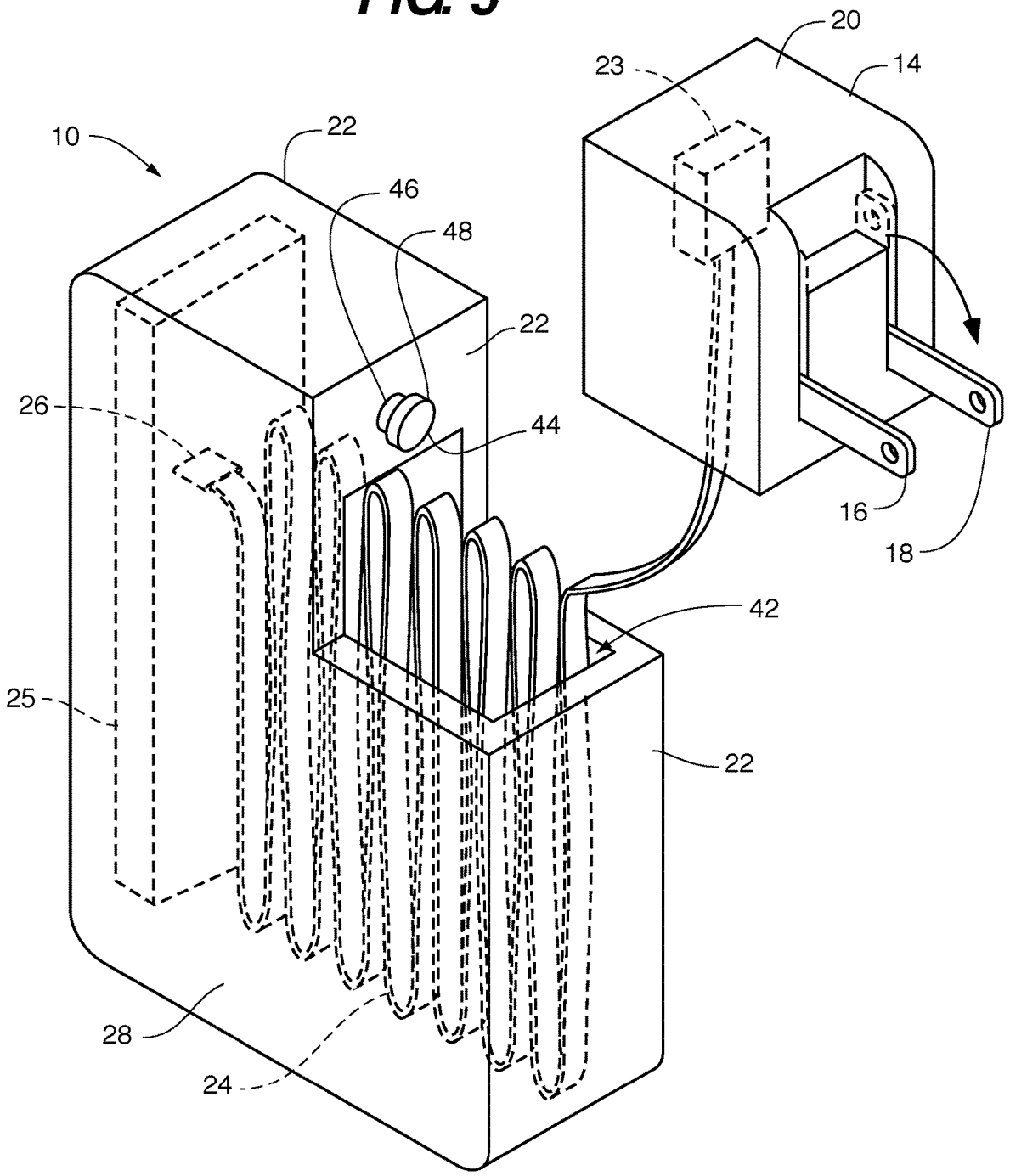
FIG. 5 is a perspective view of the AC adapter of FIGS. 1-2 shown with the plug disconnected from the adapter housing and the extension cord being initially withdrawn from within the storage cavity.

As may best be seen in FIG. 5, when in this second state, the adapter housing 12 is seen to define an opening 42 through which the extension cord 24 passes to and from the storage cavity 28 and which, when the plug 14 is affixed to the housing body 12, is closed via the plug body 20 being positioned over the opening 42 (i.e. when the adapter 10 is in the first state shown in FIGS. 1-4). When the plug 14 is disengaged from the adapter housing 12 (i.e. when the adapter 10 is in the second state shown in FIGS. 5-7) the opening 42 and the storage cavity 28 is accessible, and some length of the extension cord 24 may be withdrawn from the cavity 28 or repositioned therein as desired.

Engagement of the plug body 20 to the adapter housing 12, over the opening 42, is achieved by providing a releasable engagement mechanism between the plug body 20 and the adapter housing 12. In at least one embodiment, the engagement mechanism is a protrusion or knob 44 mounted to the surface 22 of the adapter housing above and adjacent to the opening 42. Knob 44 includes a stem portion 46 extending from the adapter surface 22, and which terminates in or supports a top portion 48 that has a greater diameter and/or surface area than the stem portion 46.

Figure 6:
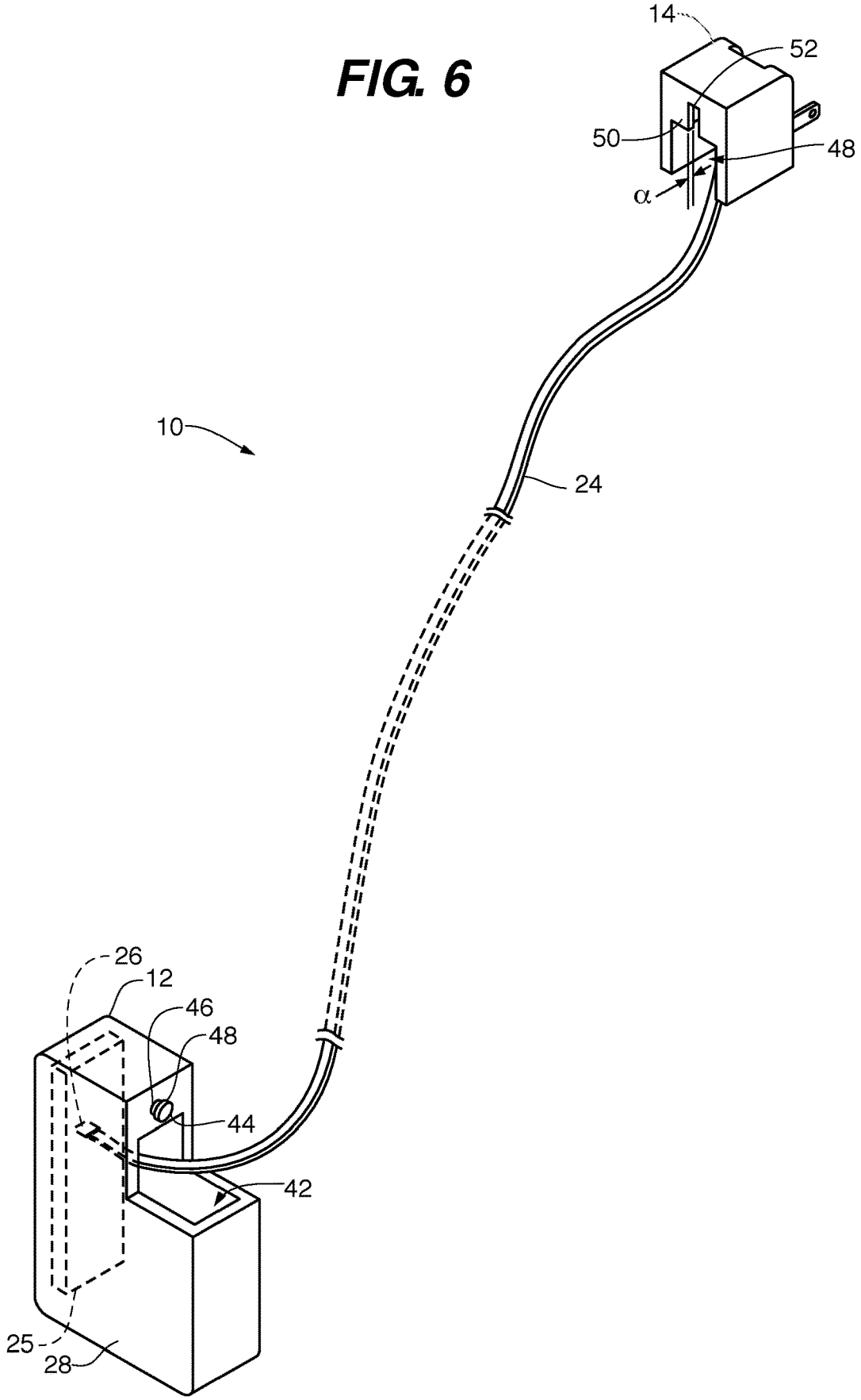
FIG. 6 is a perspective view of the AC adapter shown in FIG. 5 wherein the extension cord is extended to its full length from within the storage cavity.
Figure 7:
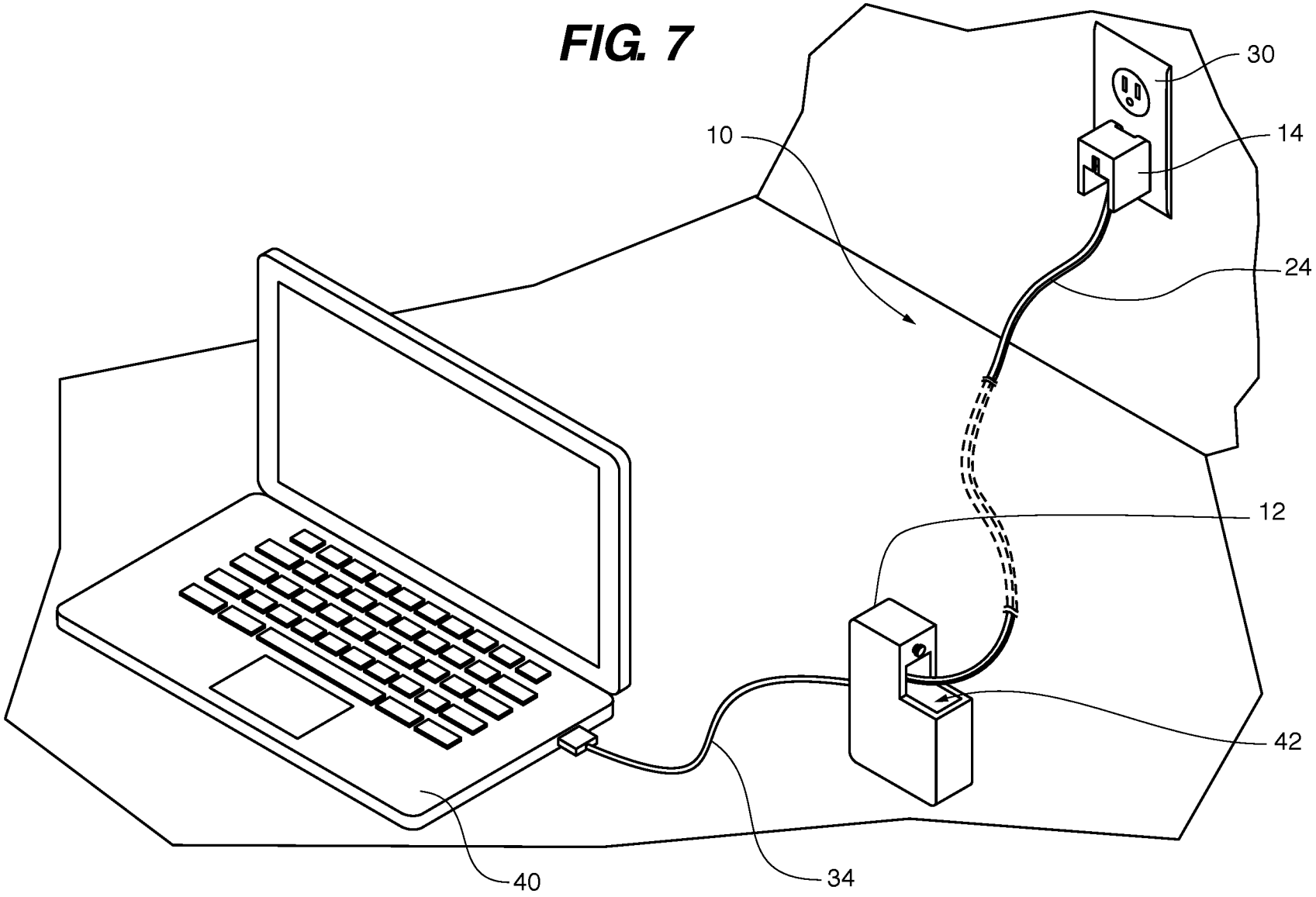
FIG. 7 is a perspective view of the AC adapter shown in FIG. 6, depicted within a typical environment of use, such shown in FIG. 3, wherein the plug is connected to the wall outlet and the adapter housing is positioned a distance away from the plug via the length of the extension cord.

As best shown in FIG. 6, the rear portion of the plug body 20 defines an interior area or space 49, and includes a rear flange 50 that define a channel 54. The flange 50 has a thickness a that is substantially the same as the height of the stem portion 46 of the knob 44. When the plug 14 is engaged to the adapter housing 12, such as in the default arrangement shown in FIGS. 1-4, the top portion 48 of the knob is positioned within the interior space 49 of the plug body 20 and frictionally engages the flange 50. The stem portion 46 of the knob 44 is positioned within the channel 54.

Figure 8:
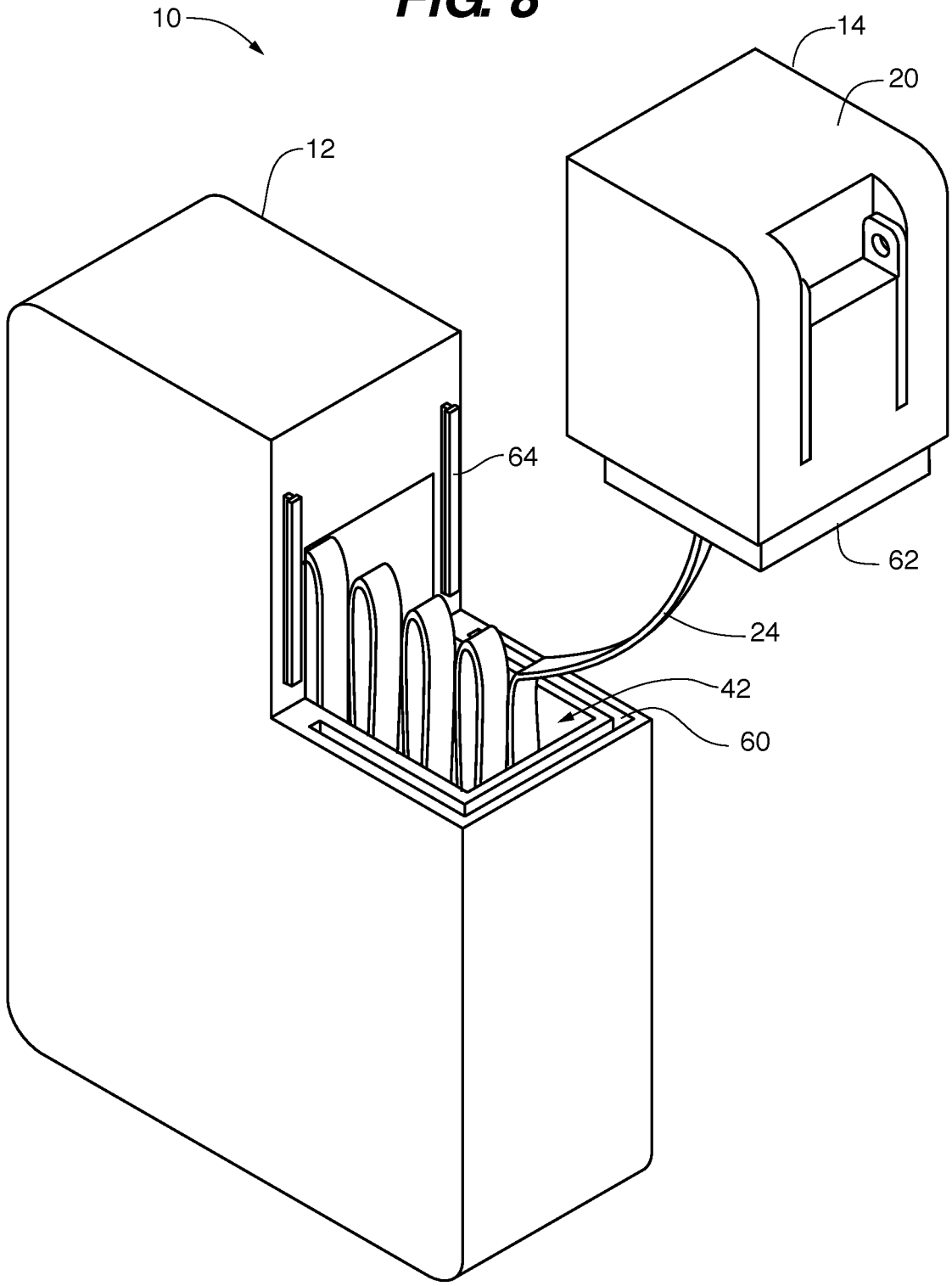
FIG. 8 is a perspective view of the AC adapter shown in FIG. 5 with the an alternative plug engagement mechanism depicted.

In an alternative embodiment shown in FIG. 8, engagement mechanisms for releasably engaging the plug 14 to the adapter housing 12 may include a variety of engagement surfaces such as for example channels or grooves 60 defined by adapter housing 12 that are sized and shaped to receive correspondingly sized and shaped protrusions 62 which extend from the plug body 20 or vice versa. Additional and/or alternative complementary engagement surfaces may include any of a variety of geometrically shapes protrusions (tenons) such as the T-shaped protrusion 64 that extends from the adapter housing 12, and which is configured to slide into a complementary shaped receiving channel (mortise) defined by the plug housing (not visible).

Figure 9:
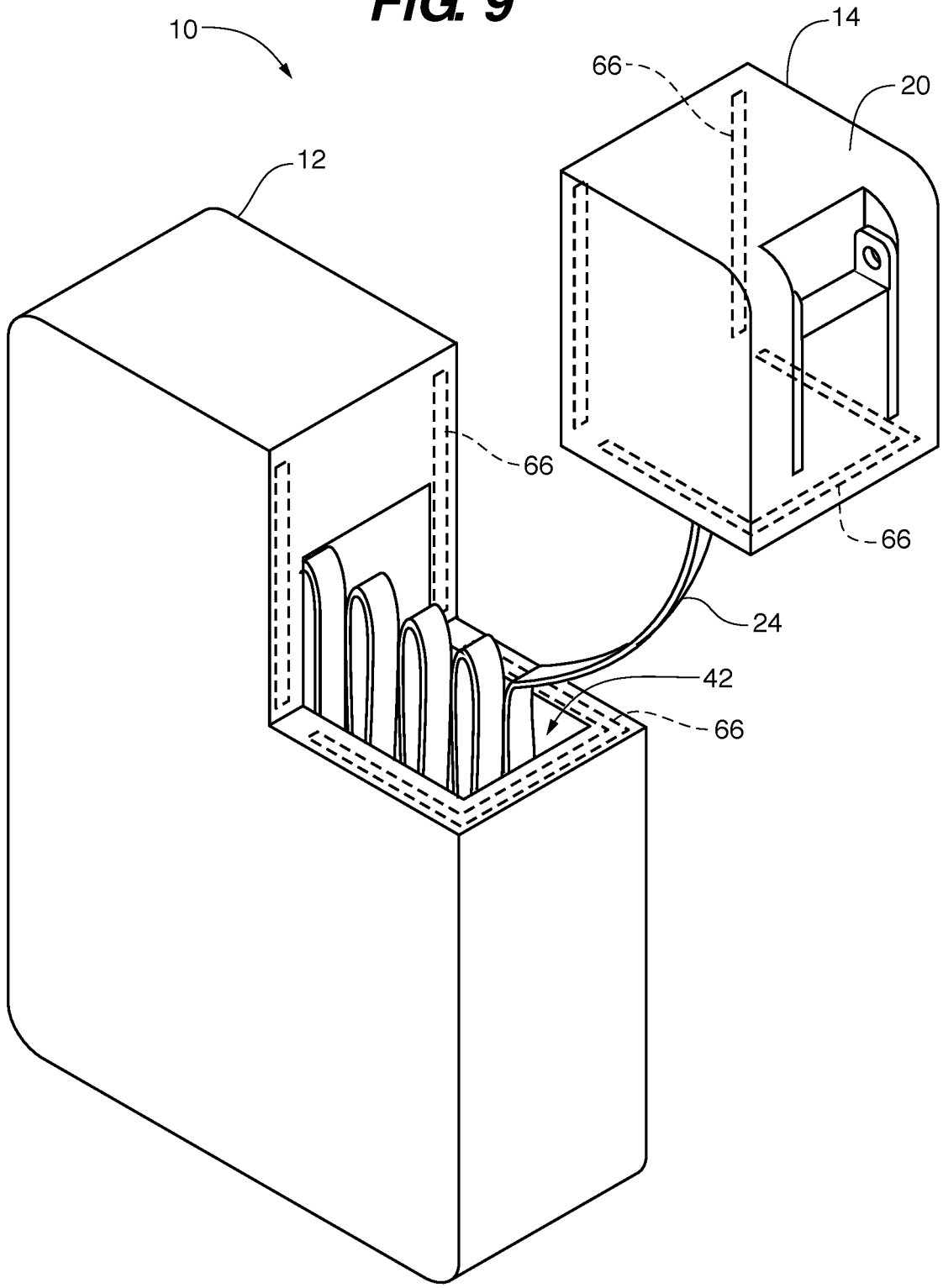
FIG. 9 is a perspective view of the AC adapter shown in FIG. 5 with another alternative plug engagement mechanism depicted.

In yet another embodiment shown in FIG. 9, the engagement mechanism for releasably engaging the plug 14 to the adapter housing 12 comprises a series of magnets 66 embedded within, or otherwise engaged to, opposing surfaces of the plug body 20 and adapter housing adjacent to the cavity opening 42. In such an embodiment the opposing surfaces of the plug 14 and adapter housing 12 that are nominally in contact with one another are provided with magnets of opposite polarity to provide a snap-fit connection between the plug 14 and adapter housing 12.

Figure 10:
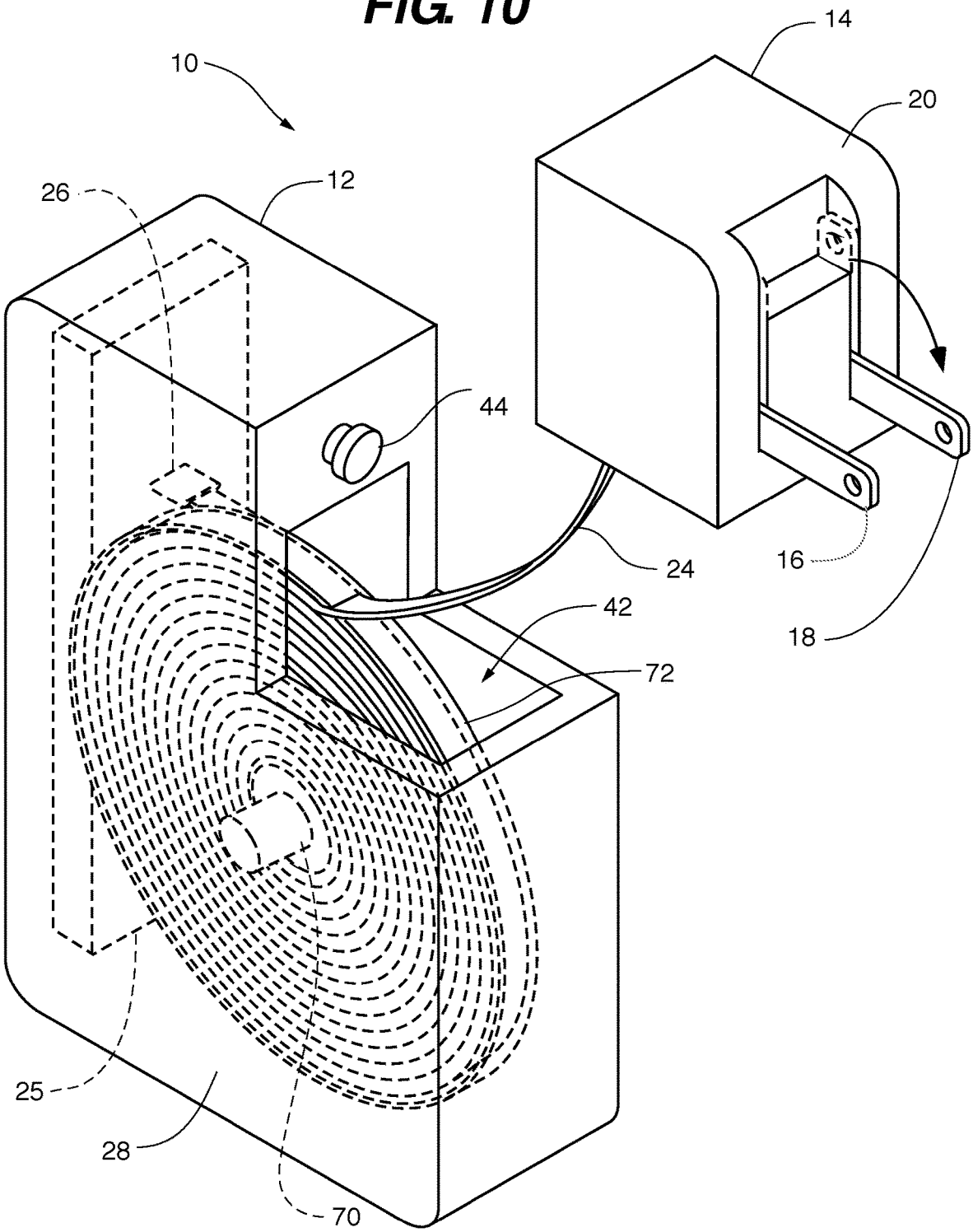

In recognition that in practice, some users of the present extension cord equipped AC adapter, may find the task of re-inserting the extension cord 24 into the storage cavity 28 an avoidable inconvenience, in at least one embodiment, such as is shown in FIG. 10, the adapter housing 12 supports a cord retraction mechanism 70 within the storage cavity 28, and which the cord 24 is contained thereon. The retraction mechanism may be any sort of conventional retraction cord mechanism that allows the plug and extension cord 24 to be withdrawn from the retraction mechanism's housing 72 to a maximum length (or any length sort of the maximum length of the cord) and which then causes the cord to be fully restored within the retraction mechanism upon some act initiated by a user (e.g. a slight pull on the cord 24, manipulating the adapter housing 12, etc).

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. An AC adapter comprising:

an adapter housing, the adapter housing defining a storage cavity and an opening into the storage cavity, the adapter housing defining at least one channel positioned adjacent to the opening into the storage cavity, the adapter housing containing electronics for converting alternating current from a power source into direct current voltage, the electronics positioned adjacent to the storage cavity;

a USB port in electrical communication with the electronics;

a plug, the plug having a plug body and two pins, the pins being foldable relative to a front surface of the plug body, the plug body having at least one protrusion extending therefrom, the at least one channel having a size and shape and position corresponding to that of the at least one protrusion, the plug has a first engagement state and a second engagement state, in the first engagement state the plug is mechanically engaged to the adapter housing such that the plug body completely covers the opening into the storage cavity, in the second engagement state the plug is removed from the mechanical engagement with the adapter housing, in the first engagement state the at least one protrusion is received into and engaged by the at least one channel;

an extension cord, the extension cord having a length extending between a first connection end and a second connection end, the first connection end is in mechanical and electrical engagement with the electronics, the second end is in mechanical and electrical engagement with the two pins of the plug body, in the first engagement state the extension cord is contained entirely within the storage cavity, in the second engagement state a portion of the length of the extension cord extends out the opening from the storage cavity.

2. The AC adapter of claim 1, wherein the plug body defines an internal area, a portion of the plug body being a flange, the flange having a thickness and defining a channel.

3. The AC adapter of claim 2 wherein a surface of the adapter housing adjacent to the opening includes an engagement knob, the engagement knob comprising a stem portion and a top portion having a greater surface area than that of the stem portion, the stem portion having a height as measured from the surface of the adapter housing, the height of the stem portion being substantially the same as the thickness of the flange, the stem portion supporting the top portion, in the first engagement state the stem portion being positioned within the channel, the top portion being positioned within the internal area of the plug body and in frictional engagement with the flange.

4. The AC adapter of claim 1, wherein a portion of the adapter housing adjacent to the opening into the storage cavity is magnetic and a portion of the plug body opposite the portion of the adapter housing is also magnetic, the portion of the adapter housing being of an opposite magnetic polarity than that of the portion of the plug body.

5. The AC adapter of claim 1, further comprising a cord retraction mechanism, the cord retraction mechanism being positioned entirely within the storage cavity and containing the length of the extension cord in the first engagement state.

* * * * *